US009084464B2

(12) United States Patent
Libuda

(10) Patent No.: US 9,084,464 B2
(45) Date of Patent: Jul. 21, 2015

(54) CASE HAVING A HOUSING AND A SLIDING TRAY

(76) Inventor: Georg Guenter Libuda, Schwenningen (DE)

( * ) Notice: Subject to any disclaimer, the term of this patent is extended or adjusted under 35 U.S.C. 154(b) by 579 days.

(21) Appl. No.: 13/391,317

(22) PCT Filed: Aug. 23, 2010

(86) PCT No.: PCT/DE2010/050061

§ 371 (c)(1),
(2), (4) Date: Feb. 21, 2012

(87) PCT Pub. No.: WO2011/020472

PCT Pub. Date: Feb. 24, 2011

(65) Prior Publication Data

US 2012/0145592 A1 Jun. 14, 2012

(30) Foreign Application Priority Data

Aug. 21, 2009 (DE) ..... 20 2009 005 168 U
Mar. 3, 2010 (DE) ..... 20 2010 000 304 U

(51) Int. Cl.
*A45C 13/26* (2006.01)
*A45C 7/00* (2006.01)
*A45C 13/02* (2006.01)

(52) U.S. Cl.
CPC ..... *A45C 13/262* (2013.01); *A45C 7/0022* (2013.01); *A45C 7/0036* (2013.01); *A45C 7/0045* (2013.01); *A45C 13/02* (2013.01); *A45C 13/26* (2013.01)

(58) Field of Classification Search
CPC .... A45C 13/262; A45C 7/0022; A45C 13/02; A45C 13/26
USPC ..... 190/110
See application file for complete search history.

(56) References Cited

U.S. PATENT DOCUMENTS

| | | | | |
|---|---|---|---|---|
| 957,704 | A | 5/1910 | McCarthy | |
| 2,177,523 | A * | 10/1939 | Geiger | 190/35 |
| 2,716,473 | A * | 8/1955 | Droutman | 190/119 |
| 2,905,480 | A | 9/1959 | Giovannelli | |
| 3,777,882 | A * | 12/1973 | McIntyre | 206/370 |
| 4,082,390 | A * | 4/1978 | Gibson et al. | 312/284 |
| 4,106,597 | A * | 8/1978 | Shook et al. | 190/110 |
| 4,273,223 | A * | 6/1981 | Tomlinson | 206/292 |
| 5,099,968 | A | 3/1992 | Kikuchi | |
| 2004/0026294 | A1 | 2/2004 | Platte, III | |

(Continued)

FOREIGN PATENT DOCUMENTS

| | | |
|---|---|---|
| DE | 2318717 A | 10/1973 |
| DE | 2020040194724 | 5/2006 |
| FR | 613735 A | 3/1926 |

*Primary Examiner* — Tri Mai
(74) *Attorney, Agent, or Firm* — Dennemeyer & Associates, LLC.

(57) ABSTRACT

The invention relates to a case (1), in particular a presentation case, comprising a housing (2), a carrying handle (3), and a part (4) that can be lifted up to open the case (1), wherein the case (1) comprises compartment dividers (9) parallel in particular to a base (6), said compartment dividers forming a plurality of compartments (8) for accommodating objects, and the part (4) that can be lifted up is formed on an access side of the compartments (8). In order to create a space-saving, light transport unit for accommodating as many objects as possible in the most compact and efficient manner possible, wherein quick access to individual objects from the compartments can be realized, the compartments can be extended in height (h-H).

22 Claims, 8 Drawing Sheets

(56) References Cited

U.S. PATENT DOCUMENTS

2005/0121275 A1* 6/2005 Platte, III ..... 190/103
2005/0126872 A1 6/2005 Dror
2005/0145458 A1* 7/2005 Cohen ..... 190/18 A
2006/0000681 A1 1/2006 Barker et al.
2007/0089954 A1 4/2007 Eradley et al.
2007/0295570 A1* 12/2007 Campbell et al. ..... 190/15 R
2008/0083592 A1* 4/2008 Mangano ..... 190/110
2008/0308371 A1* 12/2008 Yang ..... 190/18 A

* cited by examiner

CASE HAVING A HOUSING AND A SLIDING TRAY

PRIOR ART

The invention relates to a case, in particular a presentation case, having a housing, a carrying handle, and a part that can be lifted up to open the case, wherein the case comprises dividers parallel in particular to a base, said dividers forming a plurality of compartments for accommodating objects, and the part that can be lifted up is formed on an access side of the compartments. The invention further relates to a sliding tray for a case comprising dividers.

Cases for transporting goods and products are already known. Tote bags, into which storage containers may be inserted, are also suitable for transporting goods and products.

It is known to accommodate glasses, jewelry, watches, tools, promotional material, surgical instruments, porcelain, flatware, or other flat objects, for transport and subsequent presentation in flat containers that can be folded open. Such containers are mostly made of hard plastic, and have a weight of approximately 500 g. Multiple such containers are inserted into a tote bag, thus forming a heavy, transportable unit, containing, for example, presentation products for presentations.

US 2007/00 89 954 A1 describes a case according to the generic part of claim 1.

The object of the invention is to further improve a case and a sliding tray of the type mentioned above such that a light-weight transport unit for accommodating as many objects as possible in the most compact and efficient manner possible is created in a space/saving manner, wherein quick access to individual objects from the compartments should be realizable.

DISCLOSURE OF THE INVENTION

According to the invention the task is solved by means of the object of claims 1 and 15. Advantageous further embodiments are obvious from the attached claims.

One aspect of the invention is to create a case, the compartments of which are configured in a manner that the same can be extended in height. Such a case provides the advantage that a plurality of products, such as clothes, shoes, jewelry, presentation material, etc. are stored in the compartments safely and in an organized manner, and are protected from transport damage and may be transported. Furthermore, the individual products, stored for example in trays, may be quickly removed from the portable unit, since only two hand movements are necessary in order to access the contents of the tray. This may be required from time to time in order to present the product within the tray in a quick and safe manner. For this purpose the hand movements are merely the opening of the part of the case that can be swiveled, and the pulling out of the tray. This is an advantage of the invention as opposed to presentation cases according to prior art, which require a high expenditure of time for packing and unpacking due to the requirement of multiple hand movements.

According to a further preferred embodiment the part that can be swiveled is embodied on a front face vertically toward the base of the case. In this manner access to the products and objects within the trays is significantly facilitated, since the trays can be pulled out parallel to the base.

In order to be able to better handle the case, and for example, to better showcase the same during a presentation, the case comprises two parts that can be swiveled as swing doors, which are embodied, for example, with hinges on side edges of the front faces of the case.

In order to more efficiently store the objects in the case, safely and in a space-saving manner, and possibly compressed, and to safely transport the same as well as in order to be able to easily access the objects in the individual compartments once the case has been deposited, the compartments may be minimized, preferably folded, and are in particular embodied to be extended in the manner of an accordion according to one aspect of the invention, and further preferably from a height h clamping the objects to a height allowing the objects, particularly the ones inserted in the trays, to be loosely slid into and out of the compartments. The compartments can therefore be compressed in height for the transport, and are pulled up once the case has been deposited in order to easily pull out the individual trays from the compartments by means of hand movements, or to push the same back in, respectively, thus not damaging any of the objects. A further important advantage is that the objects packaged in the compressed case are secured against each other due to the compressed compartments, and therefore may not be displaced.

According to an alternative preferred embodiment the parallel compartments are embodied, in particular, such that the same can be pushed together in a telescoping manner. For example, the compartments may be embodied of a light material, such as a light metal or plastic, and may comprise an overlapping slat-like shape.

According to an embodiment further improving the invention, the compartments are made from a insertion part comprising the compartments composed of a flexible material. The flexible material provides the advantage that the same is light-weight and space-saving. It is further preferred that the insertion part comprising compartments is made from a woven cloth material, in particular nylon. It has proven advantageous, if the insertion part including compartments is made, for example, from a spinnaker cloth. Of course, the insertion part comprising compartments may also consist of non-woven film material in order to realize the invention.

In order for the insertion part comprising compartments to be able to retain the trays in a stable manner in an extended form, the case preferably has an extension mechanism, preferably comprising a lock, and in particular preferably having spring support such that the extension mechanism carries and supports the insertion part comprising compartments in the extended position. The spring support serves to easily guide the insertion part comprising compartments into the extended position. The lock may secure the insertion part comprising compartments in two positions in the extended position and in the retracted position, wherein in particular a button is embodied on each cover handle in order to release the lock from preferably two locking positions.

According to a further preferred embodiment the case comprises drawers that are embodied as sliding trays. The sliding trays have the advantage that flat products, such as jewelry, watches, or glasses, or other similar objects, may be accommodated in the case in a manner that is as efficient and compact and space-saving as possible.

The case may be composed from a plastic housing, in particular from a polycarbonate film and/or from acryl nitrile butadiene styrene copolymerisate, abbreviated as ABS. Preferably the case is made from a robust aluminum housing, for example, in order to be protected from strong transport influences. Furthermore, this increases the service life and improves the appearance.

According to another preferred embodiment the case is embodied as a trolley, having a retractable carrying handle, and at least two wheels. Such a case has the advantage that an uncomfortable carrying of the same can be omitted. The carrying handle therefore becomes a pulling handle, and the weight of the case remains close to the ground and no longer needs to be carried to the ground support.

According to one embodiment the case is embodied with a cover that can be folded up, wherein the cover is therefore folded toward the back. This provides the advantage that the weight of the pull-up mechanism is reduced, thus providing a lighter weight distribution.

According to a preferred embodiment a cover of the case is attached to the pull-up mechanism, and at least one cover handle is configured on the side opposite of the base, in particular on the cover. Using the pull-up mechanism, the insertion part with compartments may easily be expanded into the expanded position together with the cover as well as retracted from the cover by means of pulling or pushing on the carrier handle by means of a single mechanical movement in this manner. Thus the exertion of movement is reduced as opposed to the embodiment described above.

According to a preferred embodiment the cover comprises a section of a side surface each on the front face, and in particular also on the rear face, preferably at a height of an enclosure having cover handles on each front face. In this manner a compact, stable cover is formed. The cover handles comprising the pull-up mechanics are embodied as standard components as far as possible. The standard components are known from trolleys having extendable handle mechanics, including a button for releasing lockable positions. The pull-up mechanics, together with the cover, are therefore stable mechanics capable of carrying and accommodating the reducible insertion part of compartments.

According to an alternative, preferred embodiment, in order to further simplify the handling of the case, the cover of the case is embodied to be removable. In this manner a space behind the cover is no longer required for folding the same open.

In order to simplify the transport capability of the case, the case preferably comprises two carrying handles on the front faces of the housing.

According to a further preferred embodiment the case comprises a coupling device for coupling another case. The coupling device is divided into a female and a male coupling device. The female coupling device is disposed, for example, on the front side, and the male coupling device is disposed, for example, on the rear side of the case, or vice versa. At least one additional case or even multiple cases may be hooked into each other, and simultaneously embodied, for example, as a trolley. In this manner one person may easily move two cases of the same design. In the preferred embodiment the coupling device comprises a hook and eye connection in the upper case region below the cover, and a spacer in the base region on the rear side of the case. The hook and eye connection may comprise, for example, a hard plastic as the male coupling device, and the opposite side may comprise female coupling devices in the form of eyes on the opposite side on both front doors.

The task is also solved by means of a sliding tray in that the sliding tray is made from a foamed material and comprises at least one recess. Such a sliding tray is very light in weight and may be individually shaped in order to accommodate objects, particularly preferably presentation objects, in a protected manner. For example, such a sliding tray may weigh 100 to 200 grams, whereas a known plastic container may weight approximately 500 grams, which may accommodate substantially less objects. Due to a plurality of such light-weight sliding trays a plurality of product objects may be stored and transported in an organized manner.

According to a further preferred embodiment the sliding tray may be produced from at least two parts, a base and a frame. In this manner the production of the sliding tray is simplified, since only the frame is adjusted to the product size, and the base may be made from a very thin material.

For production reasons the sliding tray may preferably be producible with a base and a frame in one piece.

In a particularly preferred manner the sliding tray comprises recesses with sub-compartments. In this manner substantially more objects may be accommodated in the sliding trays as opposed to common containers, which only have, for example, nine sub-compartments. Advantageously, each negative product accommodation mold may be produced in a freely selectable manner in the sliding trays made from rigid foam. In this manner the sliding tray may therefore be produced individually according to customer request.

In the preferred embodiment the sliding tray is produced having at least one recess comprising grooves embodied in parallel with the depth in order to accommodate separating plates in the depth of the sliding tray. The separating plates form individual recesses, or compartments, respectively, in the sliding tray. In this manner the sliding tray may be produced in a simple manner and is of a particularly simple and cost-effective design.

It is understood that the features mentioned above and yet to be explained below may be used not only in each of the stated combinations, but also in other combinations.

BRIEF DESCRIPTION OF THE DRAWINGS

The invention is explained in further detail below based on an exemplary embodiment referring to the drawings. They show.

EMBODIMENTS OF THE INVENTION

Figure 1:
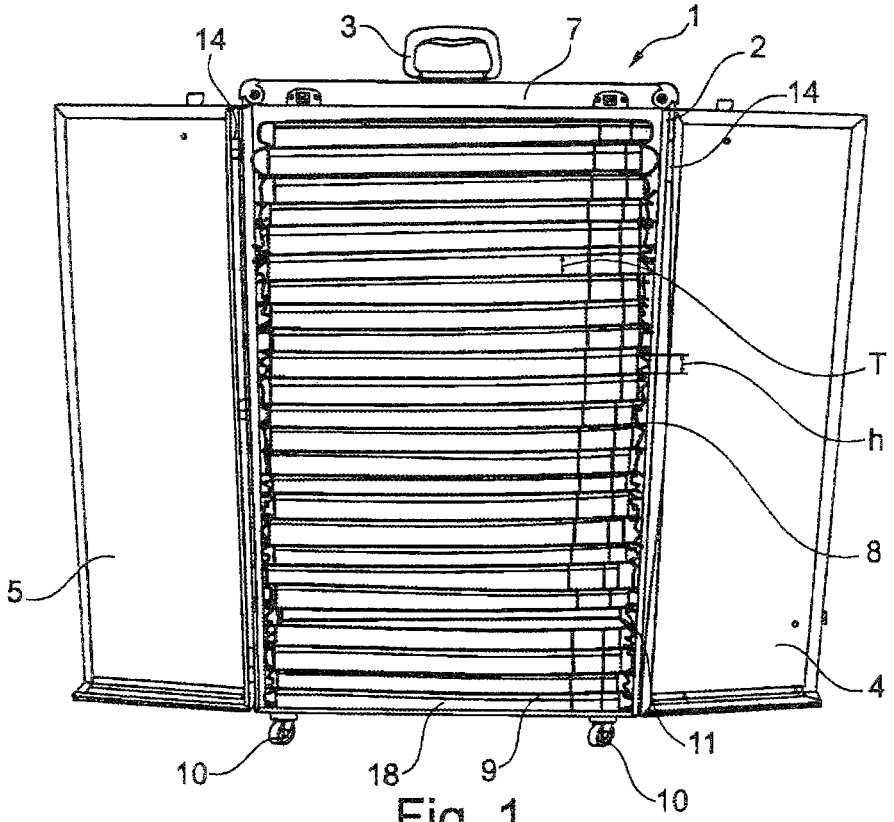
FIG. 1 a front view of the case according to the invention, having opened wing doors, FIG. 2 a front view of the case in the extended state of the insertion part comprising compartments, FIG. 3 a perspective view of the case of FIG. 2, FIG. 4 a side view of the case, FIG. 5 a perspective view of a sliding tray, FIG. 6 a top view of a insertion part comprising compartments, and FIGS. 7 to 17 illustrations of a particularly preferred embodiment.

FIG. 1 shows in a front view a case 1 according to the invention, in particular presentation case for the presentation of, for example, eye glass collections, tools, porcelain, flatware, surgical instruments, promotional material. The case 1 has a housing 2. The housing 2 comprises a cover 7, on which a carrying handle 3 is embodied. The case 1 is placed onto a horizontal surface such that its base 6 is embodied parallel to the contact surface, a base, which is not illustrated. The case 1 may be opened on one front side via two parts 4, 5 that can be swiveled and are embodied as wing doors. The wing doors are hinge-mounted on the front faces of the case 1 by means of hinges 14.

A insertion part 11 comprising compartments and comprising parallel compartment dividers 9, which are embodied parallel to the base 6, is located in the interior of the case 1. The compartment dividers 9 form a plurality of compartments 8. FIG. 1 shows 22 compartments. Drawers embodied in the form of sliding trays 18 are inserted into the compartments 8. Contrary to the illustration, the compartment dividers 9 are embodied extremely thin, as is the entire compartment insertion part 11. The compartment insertion part 11 having the compartment dividers 9 is made from a light woven cloth material, such as nylon.

The sliding trays 18 are made from a light foamed material and have a plurality of sub-compartments, in which, for example, the eye glasses may be transported individually in a gentle and organized manner. A case 1 having a plurality of sliding trays 9 is easily constructed, and is very easy to open since the wing doors are configured on an easily accessed pull-out side of the compartments 8. With only few hand movements the drawers may be pulled out such that, for example, a product collection may be quickly presented very effectively, or a desired object may be quickly removed from the case 1, or may be quickly put away, respectively.

In order to be able to move the case 1 with greater ease, rollers 10 are disposed on the bottom thereof, namely the base 6.

Figure 2:
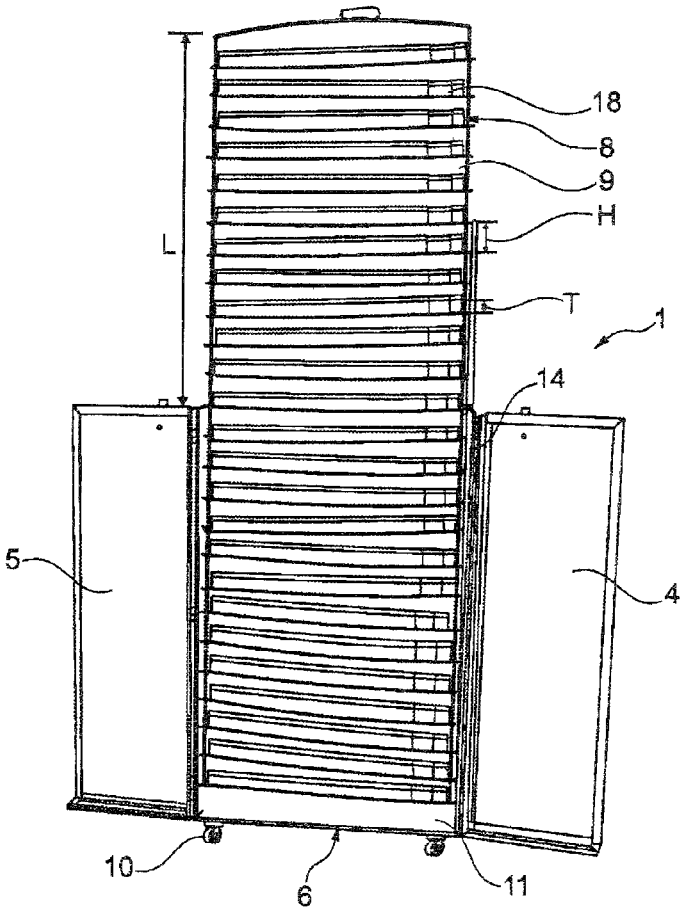

FIG. 2 shows the case 1 of FIG. 1 again in a front side view with the difference that according to the invention the compartment insertion part 11, which is foldable and extendable in the manner of an accordion, is illustrated in an extended state. By means of pulling up the insertion part 11 comprising compartments the individual height H of the compartments 8 is therefore enlarged such that the drawers are easily pulled out and pushed back in. The state shown in FIG. 1 is a compressed stated, wherein it is generally not provided to pull the drawers out, since the same are positioned tightly on top of each other in a compressed manner in order to save room and weight. The sliding trays 18 are individually separated by the compartment trays 9. The objects in the drawers are clamped by means of the compressed state, simultaneously bringing about a transport securing device such that the objects are enclosed, and thus do not damage each other during transport. The clamping and securing are released by means of the unfolding of the compartment insertion part 11 in the manner of an accordion.

The compartment insertion part 11 may be displaced into the positions shown in FIG. 1 and FIG. 2 by means of pull-up mechanics 12. The distances between the individual compartments 8 are expanded from the height h in FIG. 1, which essentially corresponds to the depth T of a sliding tray 18, to a height H, which is, for example, at least twice the depth T of the sliding tray 18. The extended length L of the pull-up mechanics 12 is therefore x times T with an x amount of compartments.

Figure 3:
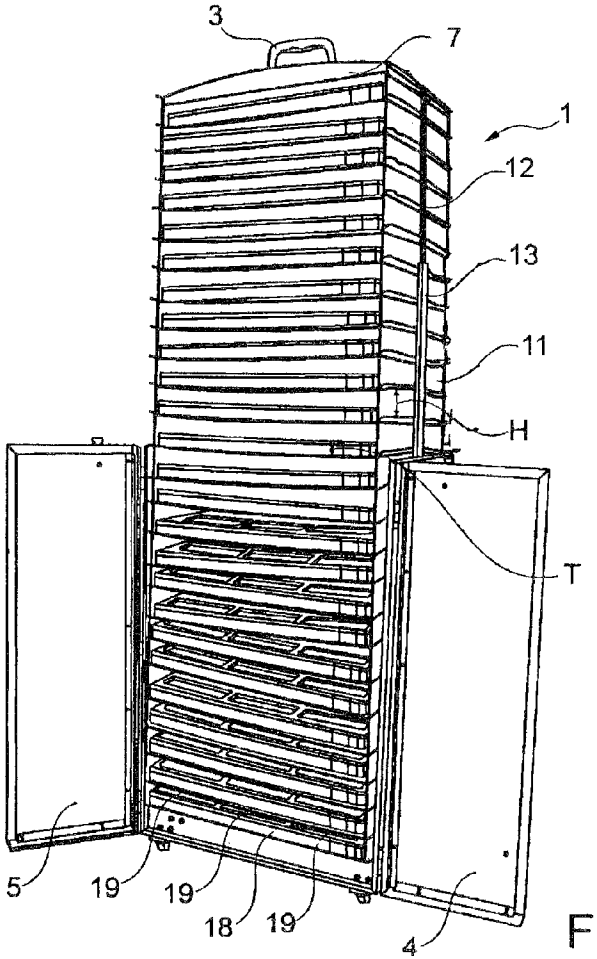

FIG. 3 shows the case 1 according to the invention in a perspective view. The compartment insertion part 11 is carried and supported by the extendable pull-up mechanics 12 in the extended position. At the end of the pull-up mechanics 12, the cover 7 is attached on top. The pull-up mechanics 12 are embodied, for example, in the form of a telescope.

The sliding trays 18 have three parallel recesses 19, for example for accommodating eye glasses, into which the glass frames may be inserted. The sliding trays 18 are embodied at a height, i.e. with a depth T, including a base 17, in order to be higher than the glass frames such that no damage of the products may occur in the folded in state of the insertion part 11 comprising compartments.

Figure 4:
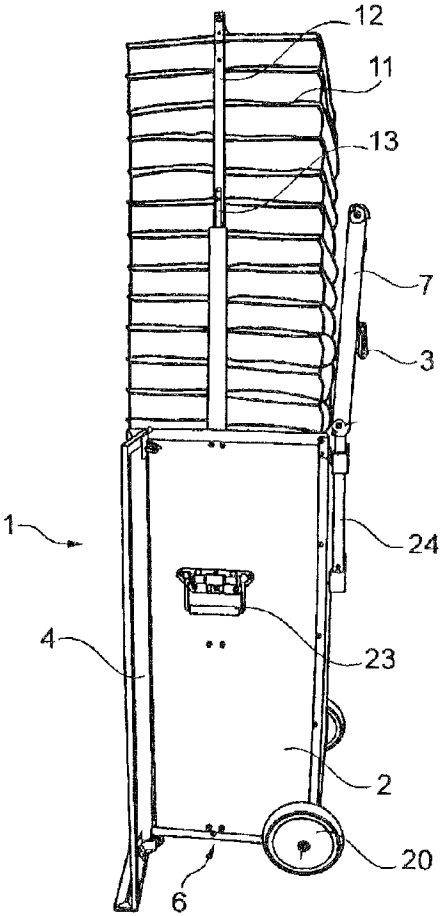

FIG. 4 shows the extended case 1 in a side view. The insertion part 11 comprising compartments is closed as viewed from this side, and is open only on the side on which the wing doors 4 and 5 may be opened as shown in FIG. 3. The insertion part 11 comprising compartments is pulled up in a manner projecting from the housing by means of the pull-up mechanics 12. The cover 7 with the carrying handle 3 is shown in a folded out toward the back and folded open manner as an alternative to the embodiment of FIG. 3. In order to retain the mechanics 12 in the extended position the pull-up mechanics 12 are embodied with a locking unit 13.

In order to simplify transport, in particular in the case of a larger case, as illustrated in FIG. 4, wheels 20 and 21 are disposed in the region of the base 6 on a side that is opposite of the side to be opened. An extendable carrying handle 24 is embodied on the rear side such that the case 1 as a whole may be easily moved as a trolley. Lateral carrying handles 23 are located on the front sides of the case 1.

Figure 5:
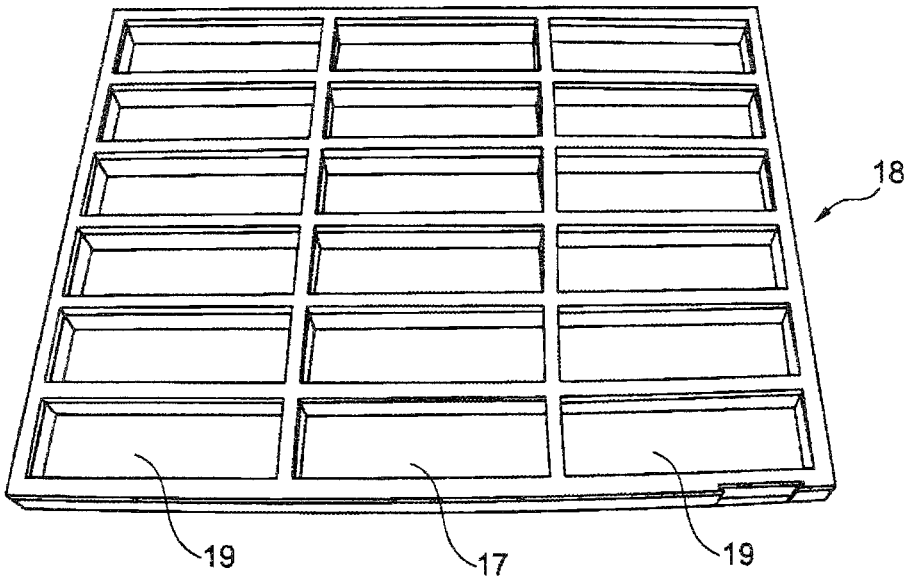

FIG. 5 shows in a perspective view a sliding tray 18 having a plurality of recesses 19. In a particular embodiment for glass frames the recesses 19 are dimensioned such that the glass frames have ample room with regard to depth, length, and width. A collection of many, here 18, in particular, glass frames, may be accommodated in a sliding tray 18. Due to a particular selection of material, namely a foamed material, the sliding trays 18 are embodied having a light-weight base 17, and are therefore very light in weight. They weigh approximately 100 to 200 grams as opposed to a rigid foam tray having less, namely for example nine sub-compartments, and weighing approximately 500 grams. Therefore, a factor 7 of weight is being saved. Additionally, such sliding trays 18 may be produced in a more cost-effective manner, and are easily integrated into the compartments 8. Furthermore, the recesses 19 embodied at a lower depth may be individually formed for the objects to be transported, because the sliding tray 18 is made from a rigid foam that is easily processed, or produced, respectively, in free form using a cost-effective method. Thus a case 1 is created that is capable of accommodating a plurality of products or objects in an organized manner in a very compressed manner. The objects are easy to access. Preferably, the case may be utilized as a presentation case for presentations of small, elongated objects. The same may be utilized in a significantly more economical manner during a presentation as opposed to common presentation containers in tote bags.

Figure 6:
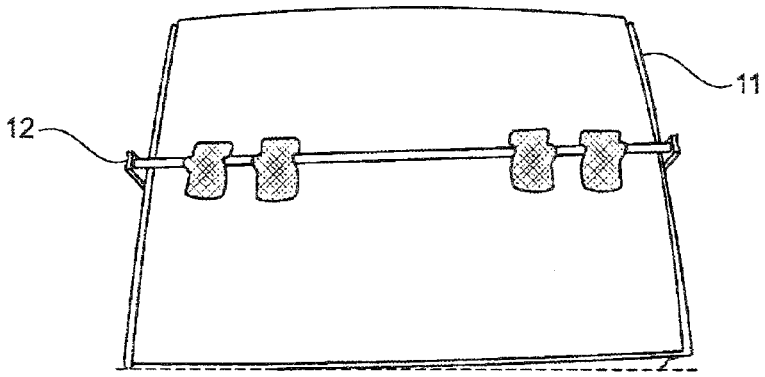

FIG. 6 shows a top view onto an insertion part 11 comprising compartments according to the embodiment of FIG. 4. The upper most cover of the insertion part 11 comprising compartments is carried by the pull-up mechanics 12.

FIGS. 7 to 14 show a particularly preferred case 1 in open, closed, and extended positions, as well as detailed illustrations.

Figure 7:
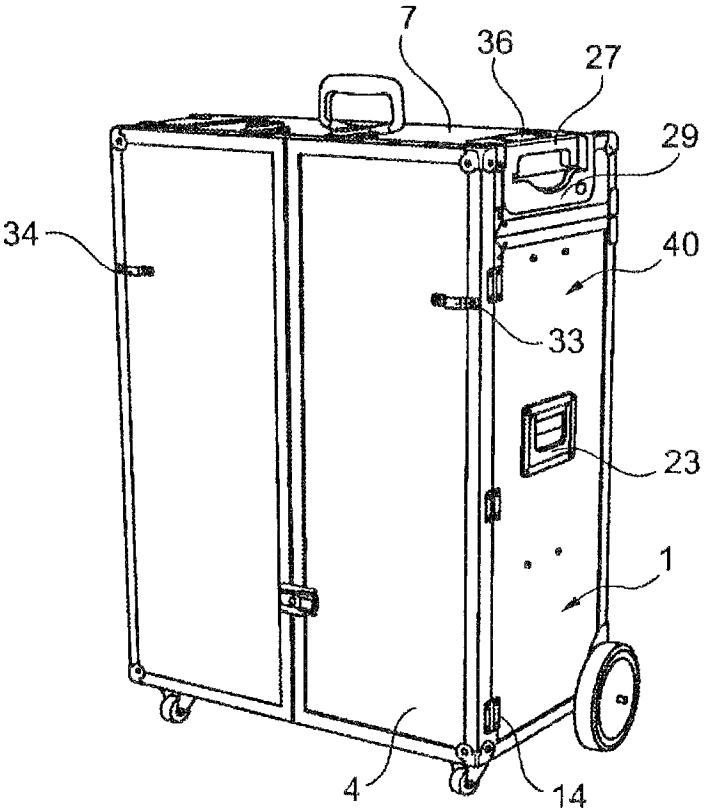
Figure 10:
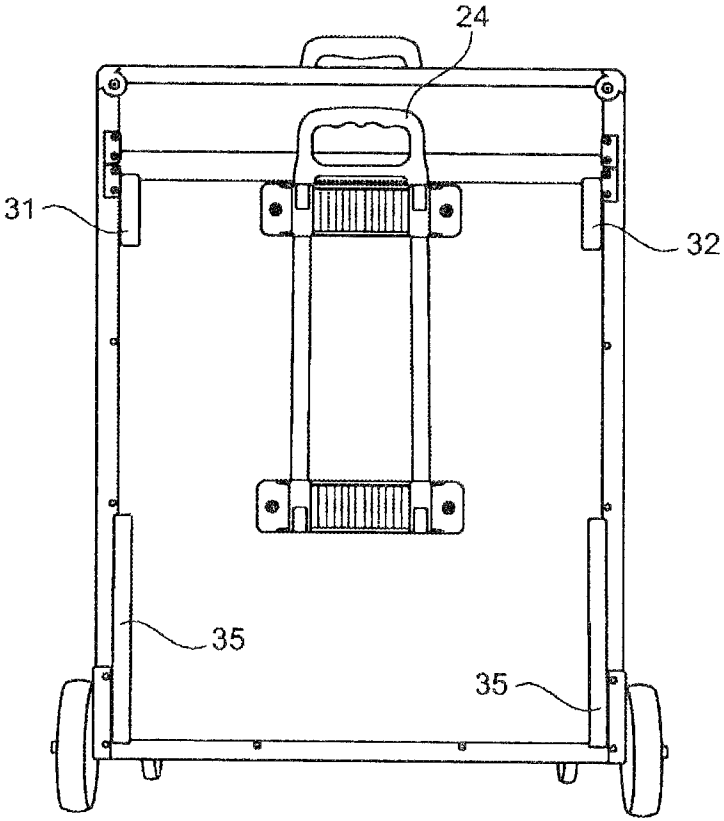
Figure 9:
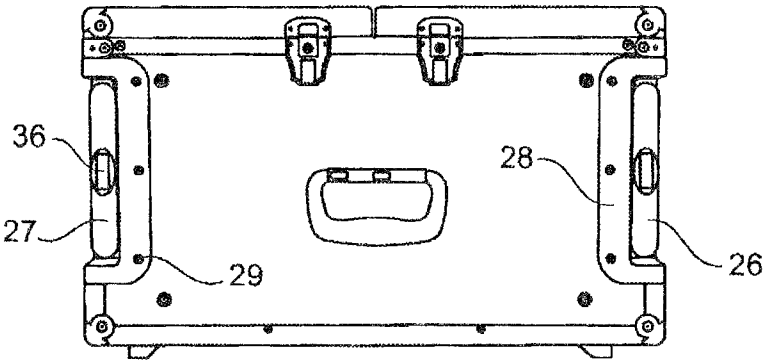
Figure 12:
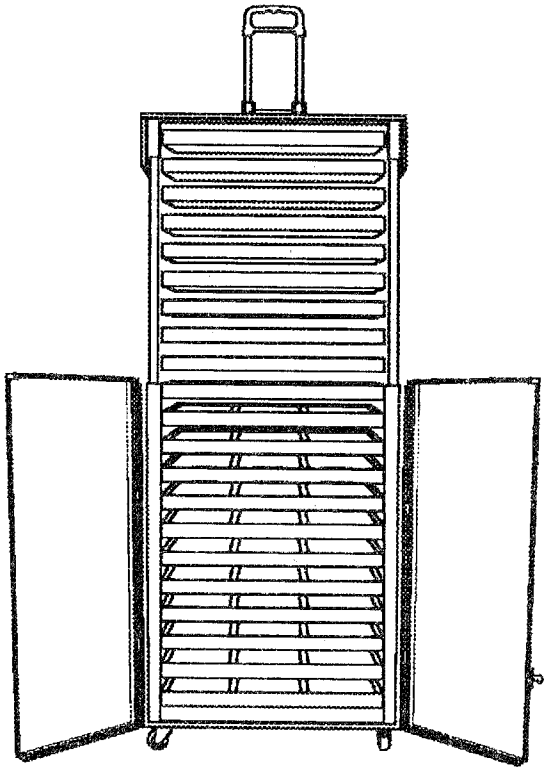
Figure 11:
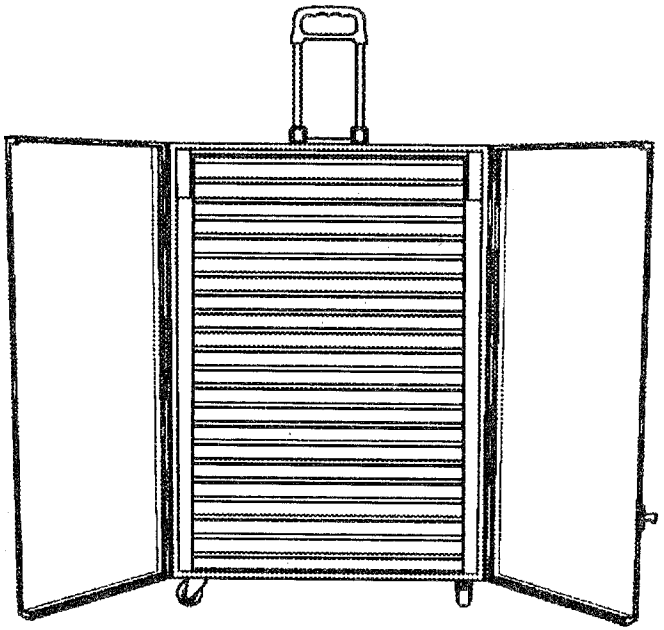

FIG. 7 shows a perspective illustration of the case 1. It is illustrated clearly that a right cover handle 27 is embodied with a right handle housing 29 in the form of a tub within the cover 7 as one unit. Telescope-type tubes are integrated on the interior of the case in the manner of a trolley case. The trolley handle embodied as a cover handle 27 in a standardized manner has an integrated button 36, by means of which two latching positions, such as a closed cover 7 and a completely extended cover 7, may be released by means of a pressure activation such that the position of the cover 7 may be displaced in the respective other position.

The cover 7 forms a partial section of the right front side 40 of the case 1, at least at the height of a handle housing 29. Furthermore, a molded lateral carrying handle 23 and hinges 14 are located on the right front side 40. The hinges 14 connect the folding part 4, which embodies the front door of the case.

Figure 8:
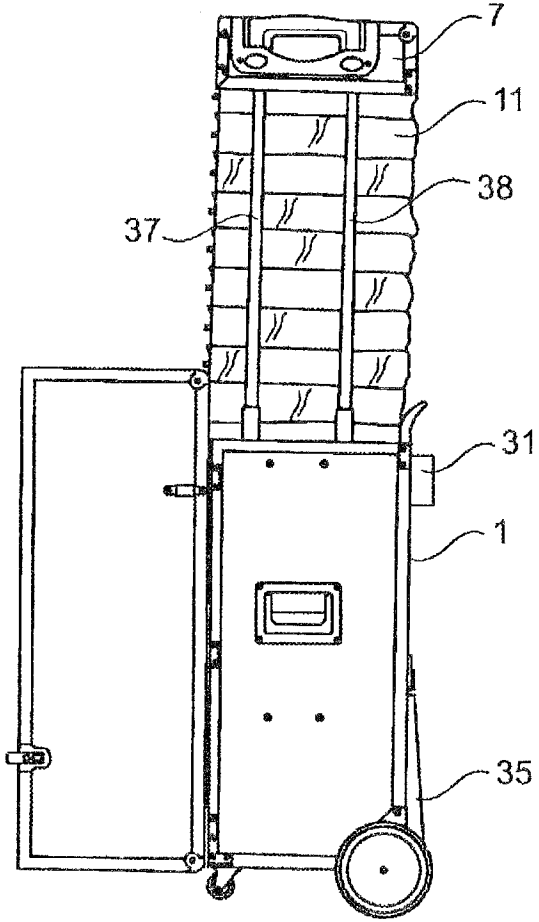

FIG. 8 shows a case 1 at a side view, having two parallel, extended telescoping rails 37, 38, which clamp the insertion part 11 comprising compartments open and carry the cover 7 in an arrested position in a latched manner. A spacer 35 and a male coupling device 31 are attached to the rear side.

Figure 13:
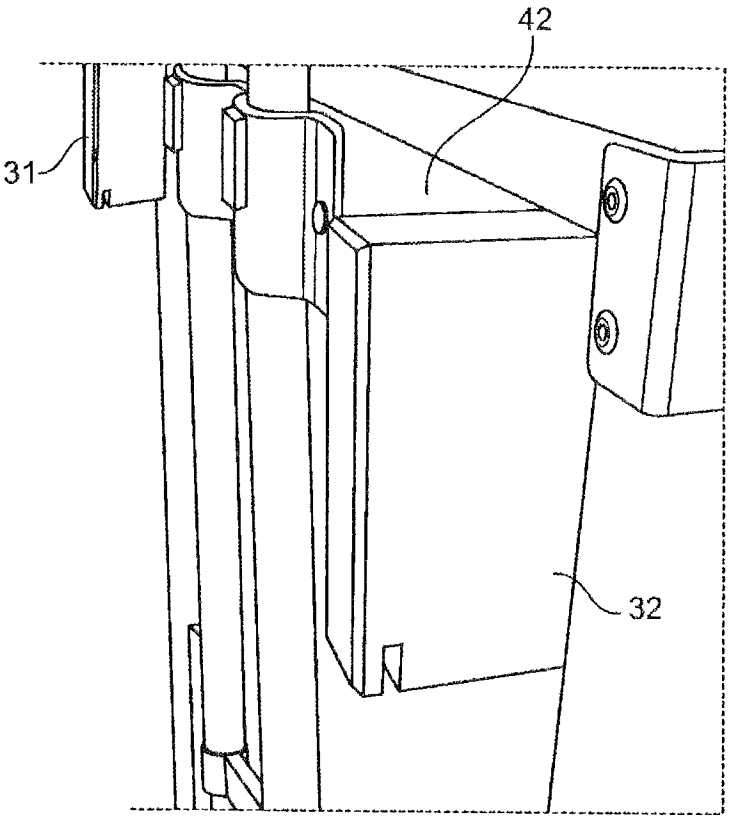

FIG. 13 shows in an enlarged view the coupling device 30 with a male coupling unit 31, 32 to the right and to the left of the exterior edges on the rear side 42 of the case 1.

Figure 14:
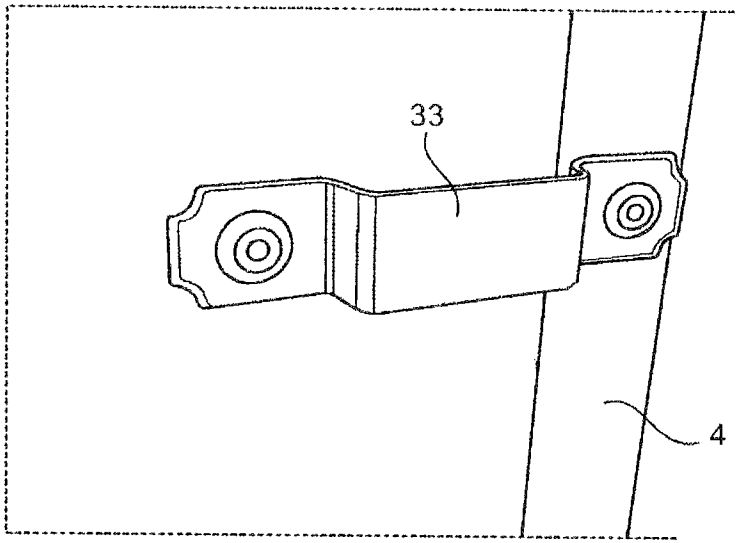

FIG. 14 shows in an enlarged view the counter part as a female coupling unit 33 on part 4.

Figure 16:
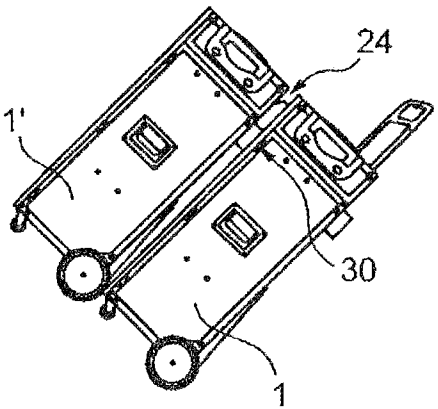
Figure 15:
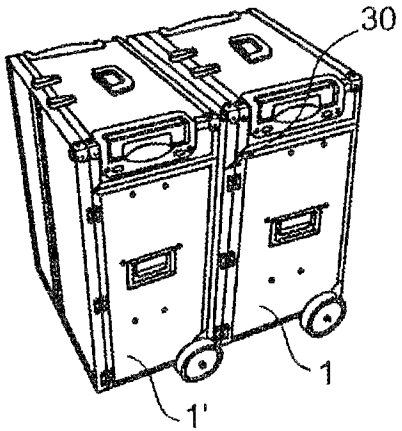

FIGS. 15, 16 show two cases 1, 1' being connected with each other via the coupling device 30. The spacer 35 on the rear side 42 of the case 1" supports the door being embodied as a folding part 4, on which the spacer 35 rests, at a distance due to the space requirement for the extendable access 24.

Figure 17:
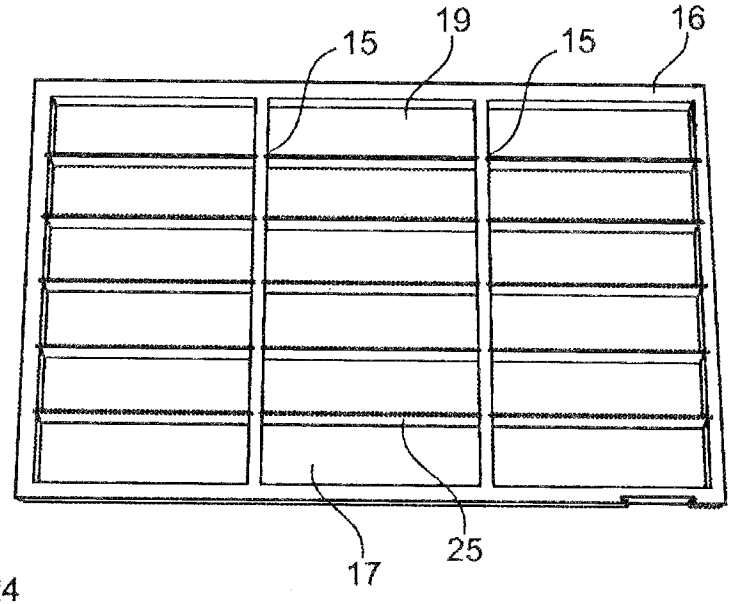

FIG. 17 shows a particularly preferred sliding tray 18 having a frame 16 and recesses 19. The recesses 19 are embodied by the frame 16 with parallel grooves 15 at a depth t by means of accommodating separating plates 25 in the grooves 15. All figures show merely schematic illustrations that are not true to scale. As to the rest reference is made in particular to the graphic illustrations essential to the invention.

The invention claimed is:

1. A presentation case, comprising a housing, a cover, a carrying handle, and a swiveling door to open the case, wherein the case comprises compartment dividers parallel to a base, forming a plurality of compartments for accommodating objects, and the swiveling door is formed on an access side of the compartments, wherein the compartments are configured to be extendable in their height, insertable and pull out drawers are disposed in the compartments for accommodating objects, wherein the compartments, in which the drawers are disposed, may be minimized to a shorter height clamping the drawers, and are configured to be extendable at a greater height at which the drawers may be loosely inserted into or pulled out of, wherein the case comprises pull-up mechanics for carrying and supporting the compartments, wherein the pull-up mechanics comprise at least one cover handle on the cover on a top of a sidewall of the case and have at least one telescope-type rail, the cover handle being movable with the pull up mechanics and the at least one cover handle being coplanar with the sidewall.

2. The case according to claim 1, characterized in that the swiveling door is configured at a front face vertically to the base of the case.

3. The case according to claim 1, characterized in that the case has two foldable parts that are embodied as wing doors.

4. The case according to claim 1, characterized in that the plurality of compartments are configured to be pushed together.

5. The case according to claim 1, characterized in that the compartments are configured from one insertion part comprising at least one compartments that is made from a flexible material.

6. The case according to claim 5, characterized in that the flexible material is a woven cloth material, in particular nylon.

7. The case according to claim 1, characterized in that the case comprises drawers that are configured as sliding trays.

8. The case according to claim 1, characterized in that the pull-up a mechanics comprise two telescope-type rails on each side-wall.

9. The case according to claim 1, characterized in that the case comprises a folding cover.

10. The case according to claim 1, characterized in that the case includes a removable cover.

11. The case according to claim 1, characterized in that the case is made from aluminum.

12. The case according to claim 1, characterized in that the case comprises a trolley, having an extendable carrying handle and at least two wheels.

13. The case according to claim 1, characterized in that the side surfaces of the cover comprise a width such that the cover handles are retractable into the front side.

14. The case according to one claim 1, characterized in that the case comprises a carrying handle on the cover on the side opposite of the base.

15. The case according to claim 1, characterized in that the case comprises two carrying handles on the front sides.

16. The case according to claim 1, characterized in that the case comprises a coupling device for coupling another case thereto.

17. The case according to claim 1, characterized in that the sliding tray is made from a foamed material, and has at least one recess.

18. The case according to claim 17, characterized in that the sliding tray comprises two parts, namely a base and a frame.

19. The case according to claim 17, characterized in that the sliding tray is a unitary unit comprising a base and a frame.

20. The case according to claim 17, characterized in that the sliding tray comprises at least one recess to create sub-compartments.

21. The case according to claim 18, characterized in that the frame of the sliding tray is configured having at least one recess with grooves parallel to the depth of the sliding tray in order to accommodate separating plates.

22. The case according to claim 1, characterized in that a button is configured on each cover handle in order to release a lock from at least one locking positions.

* * * * *